US008251747B2

(12) United States Patent
He et al.

(10) Patent No.: US 8,251,747 B2
(45) Date of Patent: Aug. 28, 2012

(54) ELECTRICAL CONNECTOR WITH IMPROVED GROUNDING MEANS

(75) Inventors: Jia-Yong He, Kunshan (CN); Qi-Sheng Zheng, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 321 days.

(21) Appl. No.: 12/752,393

(22) Filed: Apr. 1, 2010

(65) Prior Publication Data

US 2010/0255727 A1 Oct. 7, 2010

(30) Foreign Application Priority Data

Apr. 2, 2009 (CN) ..... 2009 2 0301867

(51) Int. Cl.
*H01R 13/648* (2006.01)

(52) U.S. Cl. ..... 439/607.28; 439/95; 439/939

(58) Field of Classification Search ..... 439/607.3, 439/607.28, 939, 95
See application file for complete search history.

(56) References Cited

U.S. PATENT DOCUMENTS 7,467,977 B1 12/2008 Yi et al.

*Primary Examiner* — Tulsidas C Patel
*Assistant Examiner* — Travis Chambers
(74) *Attorney, Agent, or Firm* — Wei Te Chung; Andrew C. Cheng; Ming Chieh Chang

(57) ABSTRACT

An electrical connector (100) includes an insulative housing (1) having a receiving cavity (10) including a first receiving cavity (12) and a second receiving cavity (13) communicating with the first receiving cavity; a set of first contacts (41) protruding into the first receiving cavity; a set of second contacts (42) exposed to the second receiving cavity; a metal shell (5) enclosing the insulative housing; and a grounding means (6) attached to the metal shell and oblique to a front face (112) of the insulative housing for abutting against a metal panel and having an opening. The opening includes a lower opening (601) with a pair of chamfers (603) on top thereof and an upper opening (602) communicating with the lower opening in a vertical direction and being essentially narrower than the lower opening (601).

20 Claims, 6 Drawing Sheets

ELECTRICAL CONNECTOR WITH IMPROVED GROUNDING MEANS

BACKGROUND OF THE INVENTION

1. Field of the Invention

The present invention relates to an electrical connector, and more particularly to electrical connectors with improved grounding means.

2. Description of Related Art

Electrical connectors present as a medium being widely used in computers and other electronic devices for electrically connecting the electronic device with each other to transmit signals. A common electrical connector usually includes an insulative housing, a plurality of contacts retained in the insulative housing for transmitting signals, and a metal shell covering the insulative housing for shielding the electrical connector from being disturbed.

When the electrical connector is used in computers and other electronic devices, static electricity will stay in the metal shell. Therefore, there will need a grounding means electrically for connecting the shell to a metal panel of the computers or other electronic devices to eliminate the static electricity in the shell.

Hence, an improved electrical connector with an improved grounding means is desired to overcome the above problems.

BRIEF SUMMARY OF THE INVENTION

According to one aspect of the present invention, an electrical connector comprises: an insulative housing defining a receiving cavity for receiving a plug, the receiving cavity comprising a first receiving cavity with a first tongue portion extending therein, and a second receiving cavity communicating with the first receiving cavity with a second tongue portion extending therein; a plurality of first contacts disposed on opposite upper and lower surfaces of the first tongue portion and protruding into the first receiving cavity; a plurality of second contacts disposed on a mounting surface of the second tongue portion and exposed to the second receiving cavity; a metal shell enclosing the insulative housing; and a grounding means attached to the metal shell and oblique to a front face of the insulative housing for abutting against a metal panel and defining an opening for insertion of the plug. The opening comprises a lower opening with a pair of chamfers on top thereof acting as keys for regulating the insertion orientation of the plug, and an upper opening communicating with the lower opening in a vertical direction and being essentially narrower than the lower opening.

According to another aspect of the present invention, an electrical connector comprises: an insulative housing defining a front face and a receiving cavity recessed backwardly from the front face for receiving a plug, and a pair of slots at two lateral sides of the receiving cavity and communicating with the receiving cavity; a plurality of contacts extending into the receiving cavity for mating with the plug; a metal shell enclosing the insulative housing and comprising a top wall, a pair of side walls extending downwardly from two lateral sides of the top wall, a front wall bending downwardly from front end of the top wall, the front wall defining an inserting hole in accordance with the receiving cavity, the side walls having a pair of engaging arms bending backwardly from respective front sides thereof for being retained into the respective slots and protruding into the receiving cavity for abutting against two sides of the plug; and a grounding means comprising a main plate extending obliquely relative to the front face of the insulative housing and defining an opening in accordance with the receiving cavity, a retaining plate integrally extending from a bottom edge of the main plate and sandwiched between the front wall and the front face of the insulative housing, and a bending plate bending backwardly at an appropriate angle relative to the main plate for abutting against the metal panel. The retaining plate comprises a bight portion connecting to the bottom edge of the main plate for being sandwiched between the front wall and the front face of the insulative housing, a pair of tangs extending from the bight portion and retained in clearances formed between the front wall and the engaging arms.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
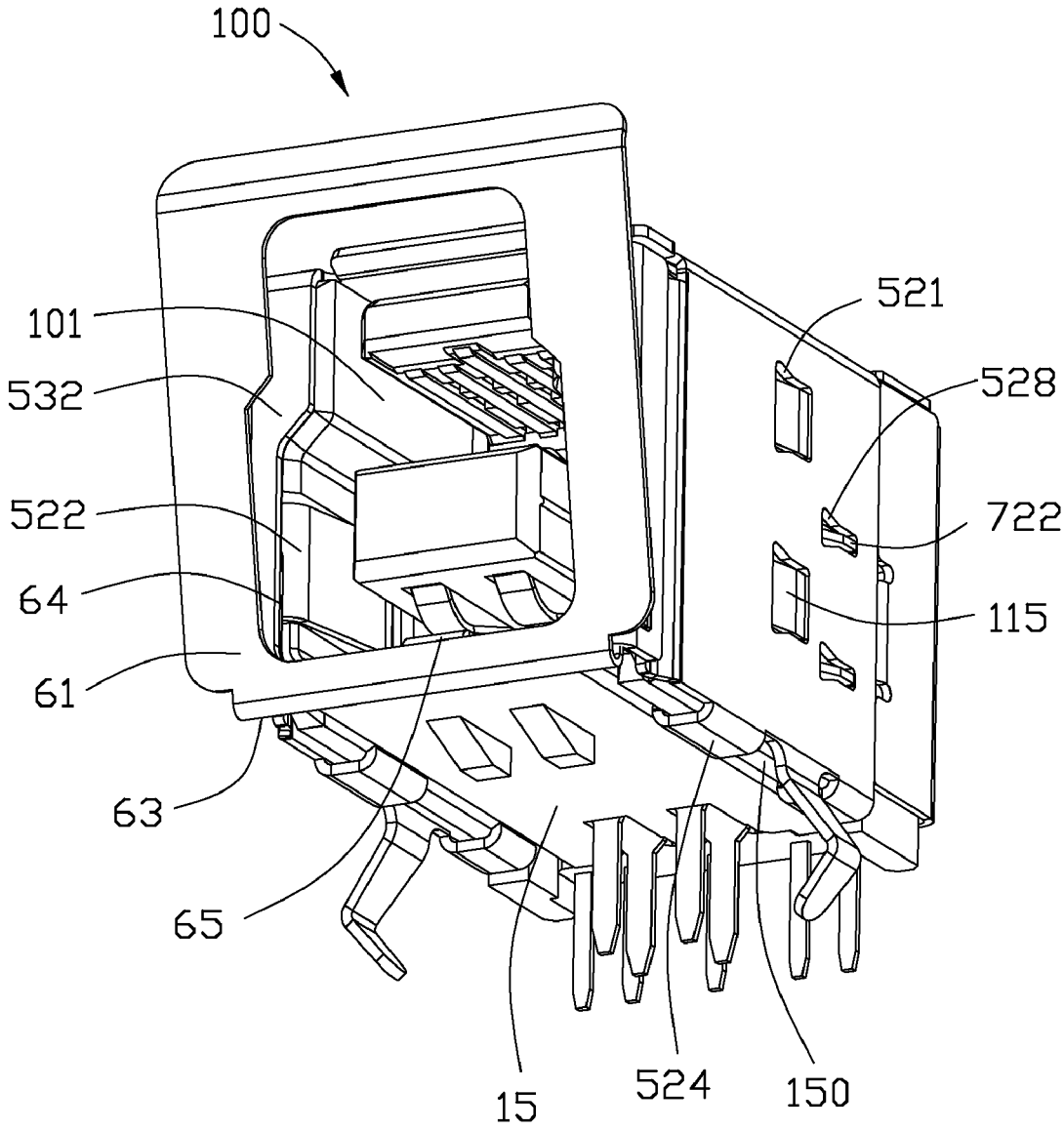
FIG. 1 is a perspective view of an electrical connector according to the present invention.
Figure 2:
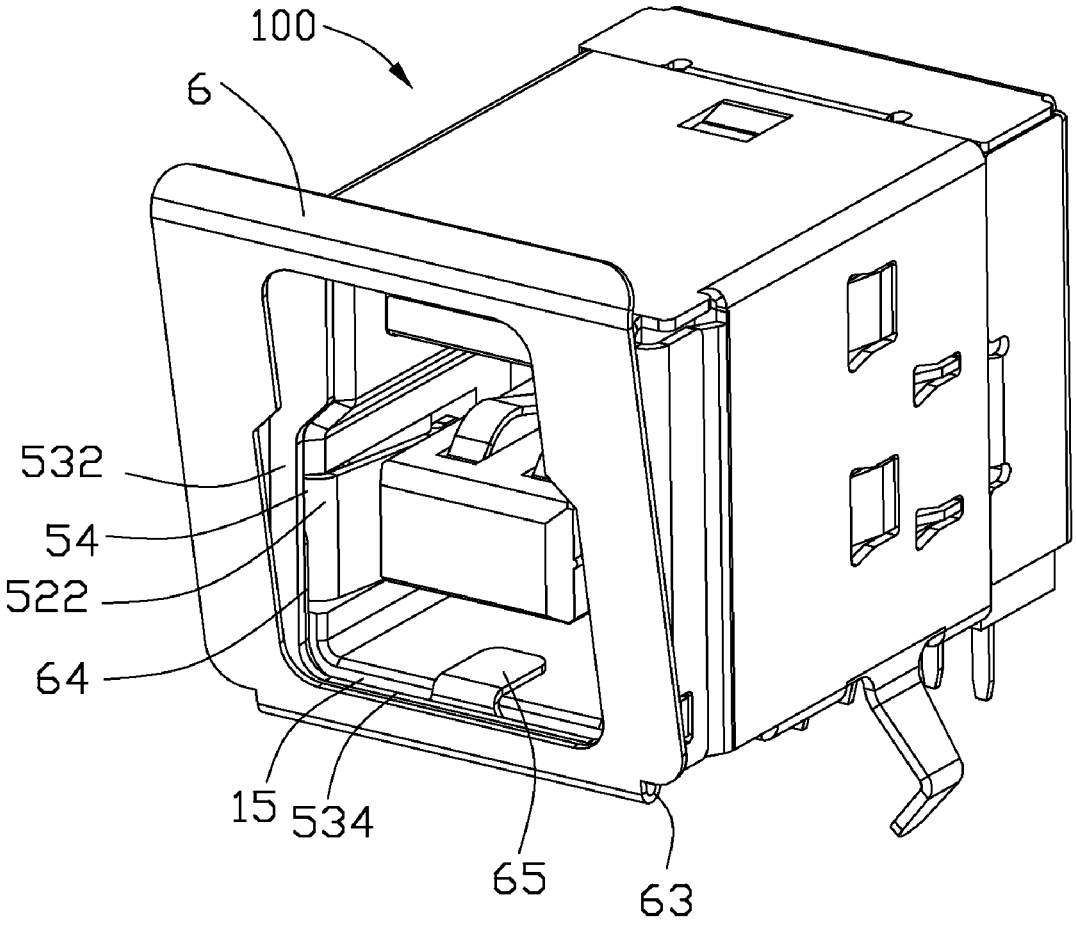
FIG. 2 is a view similar to FIG. 1, while taken from another aspect.
Figure 3:
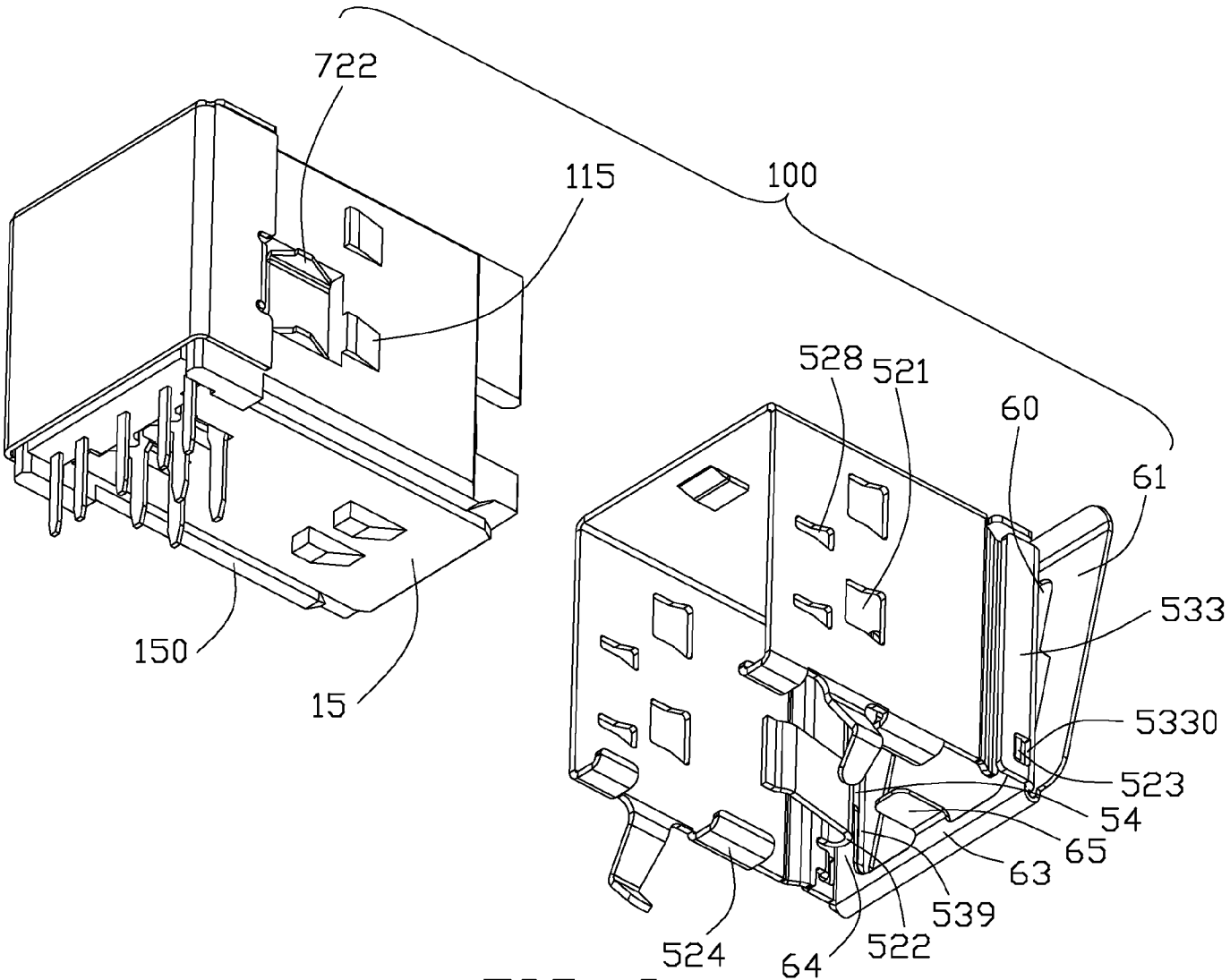
FIG. 3 is a partly exploded view of the electrical connector shown in FIG. 1.
Figure 4:
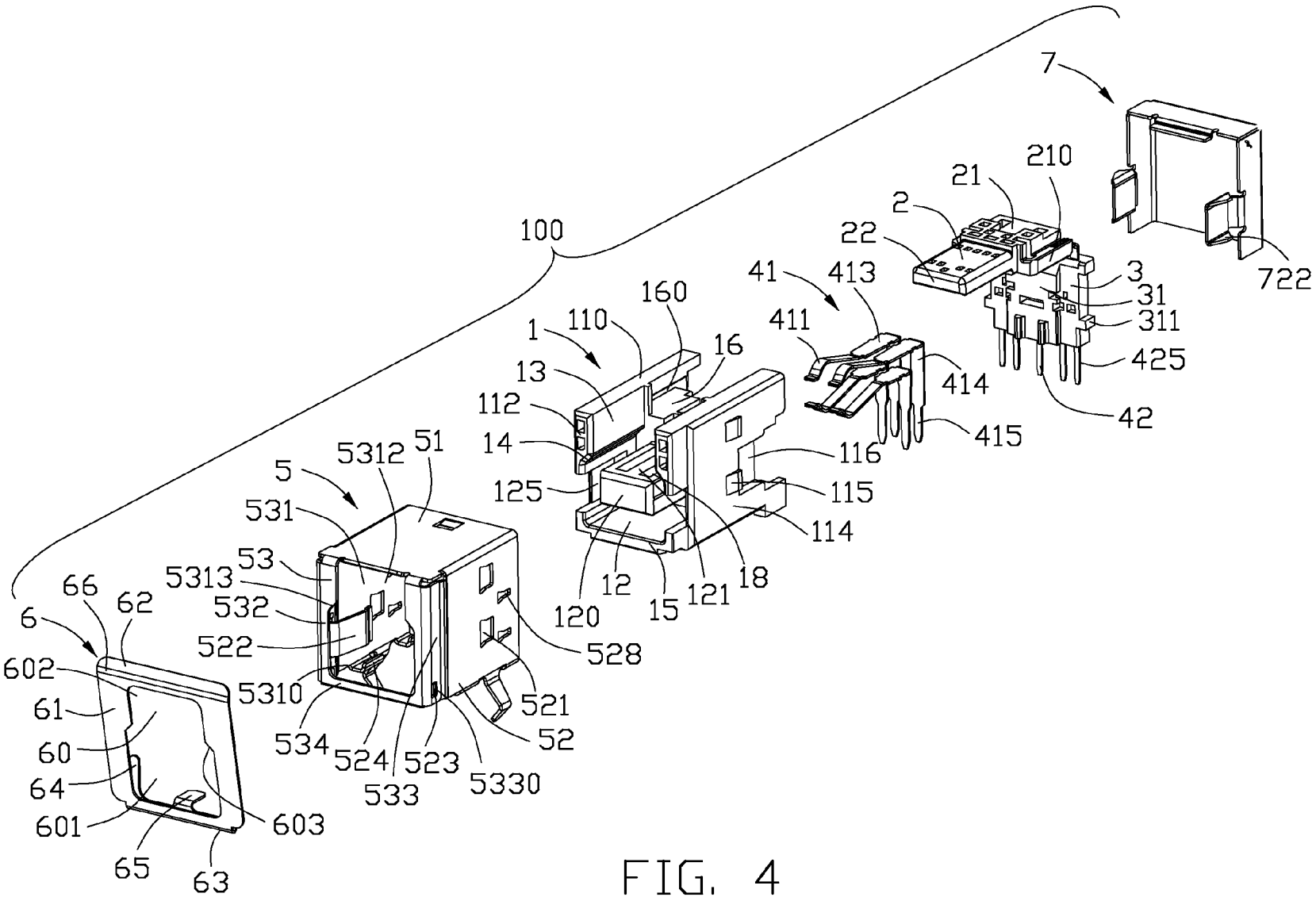
FIG. 4 is an exploded view of the electrical connector shown in FIG. 1.
Figure 5:
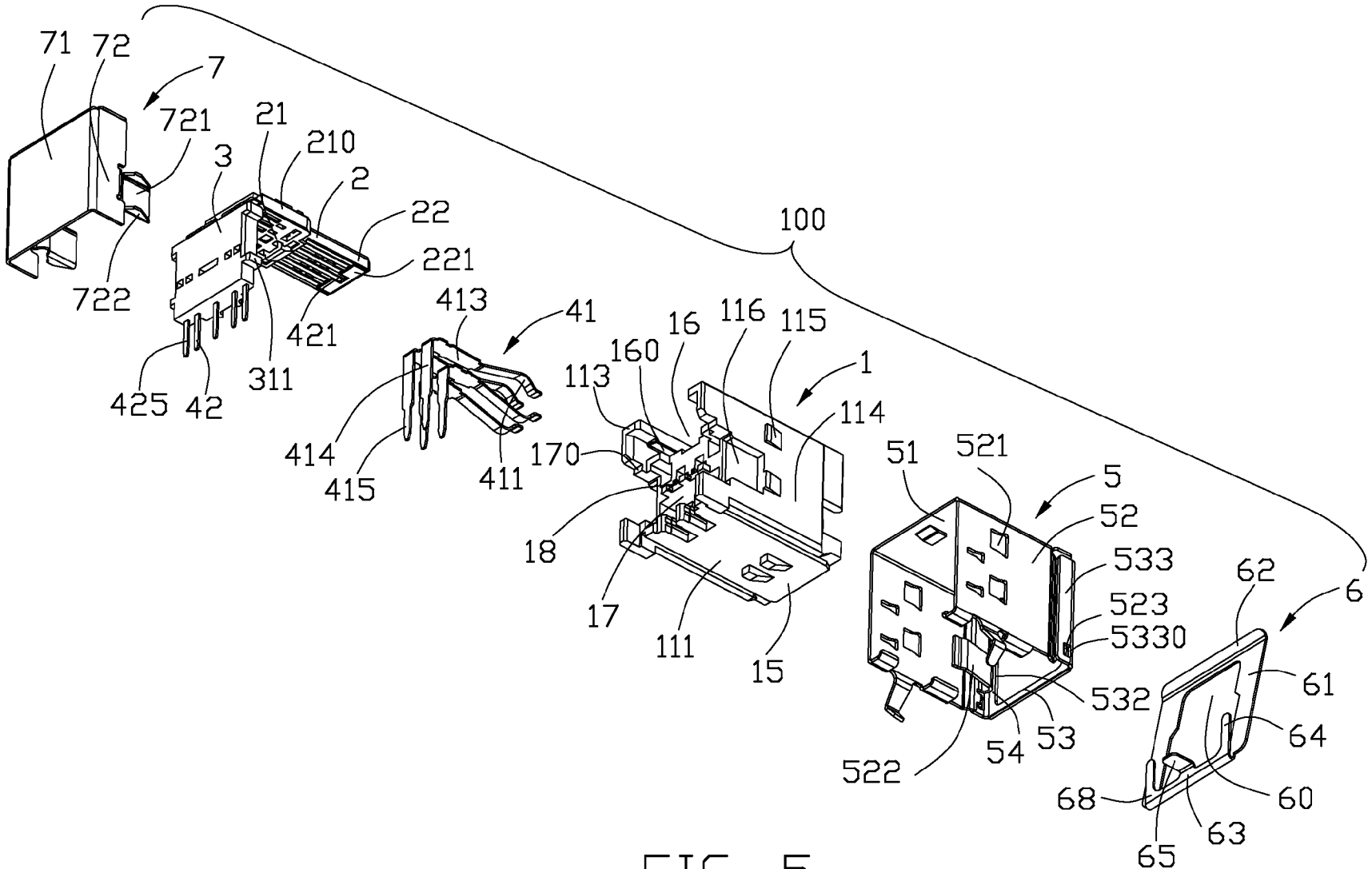
FIG. 5 is another exploded view of the electrical connector shown in FIG. 1.
Figure 6:
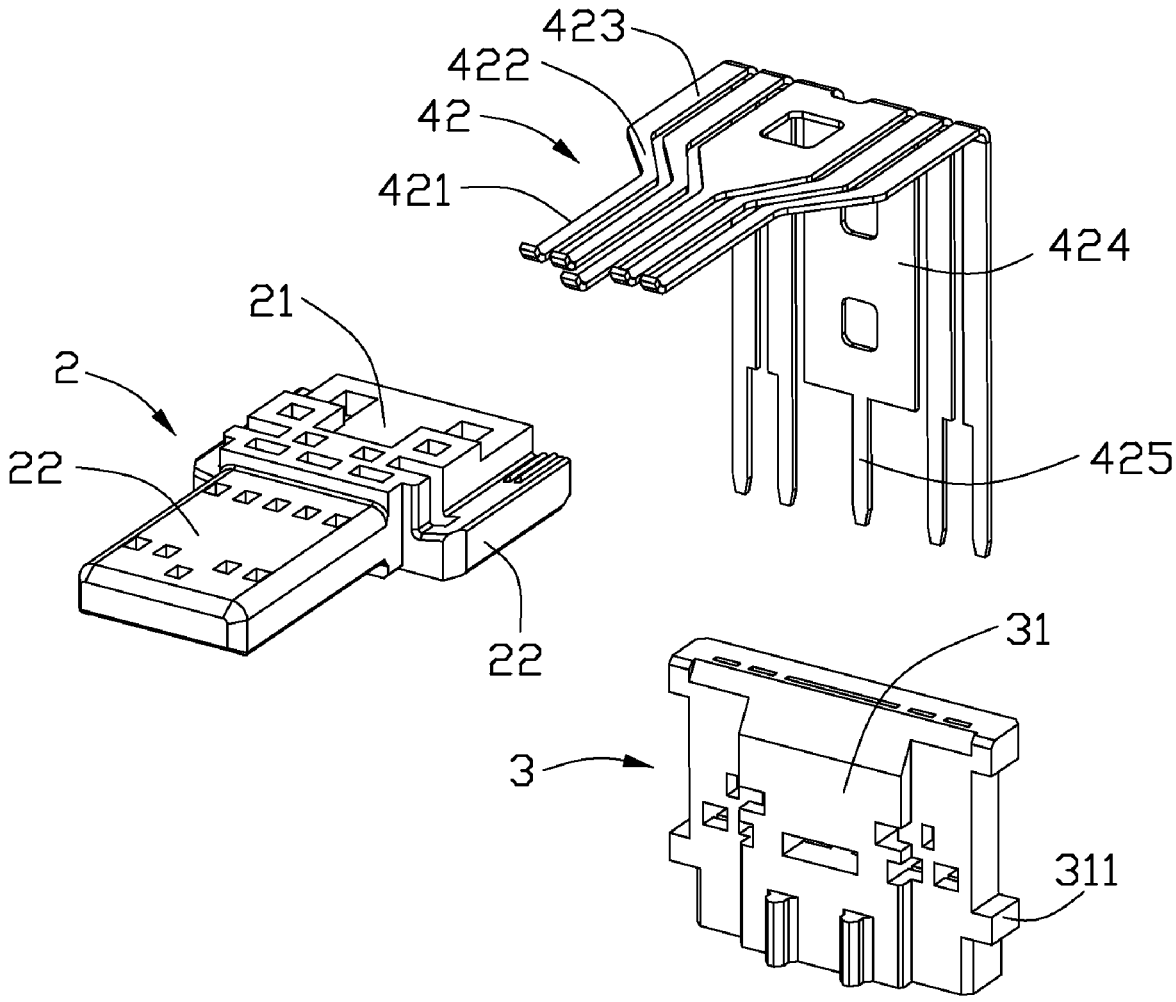
FIG. 6 is an exploded view of a contact module of the electrical connector shown in FIG. 1.

Referring to FIGS. 1, 4 and 5, an electrical connector 100 according to the present invention is disclosed. The electrical connector 100 is a B-type USB 3.0 receptacle and has a receiving cavity 101 for non-simultaneously receiving a B-type USB 2.0 plug (not shown) or a B-type USB 3.0 plug (not shown). The electrical connector 100 is mounted on a printed circuit board (PCB, not shown) and includes an insulative housing 1, a contact module assembled to the insulative housing 1, a plurality of first contacts 41 retained in the insulative housing 1, a metal shell enclosing the insulative housing 1 for EMI protection, and a metallic grounding means 6 retained on the shell for abutting against a metal panel of a computer case or else.

Referring to FIGS. 4 and 5, the insulative housing 1 is molded of dielectric material such as plastic or the like, and has a top face 110, a mounting face 111 opposite to the top face 110, a front face 112 facing the corresponding plug, a back face 113 opposite to the front face 112 and a pair of side faces 114 at two lateral sides thereof. A pair of projections 115 projecting outwardly from the side faces 114 to lock with the shell. A pair of recesses 116 recessed inwardly from two side faces 114 and passing through the back face 113. The receiving cavity 101 comprises a first receiving cavity 12 with a first tongue portion 120 extending thereinto, and a second receiving cavity 13 with the contact module extending thereinto. The first and the second receiving cavities 12, 13 communicate with each other in a vertical direction, the first receiving cavity 12 is much larger than the second receiving cavity 13. The first tongue portion 120 is formed integrally with the insulative housing 1 and extends forwardly from a rear base portion of the insulative housing 1. The first tongue portion 120 has a pair of opposite upper and lower surfaces 121.

The width of the first receiving cavity 12 is larger than the width of the second receiving cavity 13. The height of the first receiving cavity 12 is larger than the height of the second receiving cavity 13. The second receiving cavity 13 is substantially rectangular shaped. The insulative housing 1 has a pair of chamfered portions 14 on an upper left corner and an upper right corner of the first receiving cavity 12, respectively. The chamfered portions 14 act as keys for regulating the insertion orientation of the B-type USB 2.0 plug or the B-type USB 3.0 plug. A bottom wall 15 locates under the first receiving cavity 12 and has a pair of ribs 150 protruding downwardly from the mounting face 111 and locating at two lateral sides thereof. The insulative housing 1 has a pair of slots 125 formed at two sides of the first receiving cavity 12 and communicating with the first cavity 12. The insulative housing 1 further has a back receiving room 16 for accommodating the contact module and a depression 17 recessed forwardly from the back face 113. The receiving room 16 communicates with the second receiving cavity 13 in a front-to-back direction and passes through the top face 110 upwardly. The insulative housing 1 has a pair of retaining grooves 160 locating at two sides of the receiving room 16 and communicating with the receiving room 16. The depression 17 locates below the receiving room 16. The insulative housing 1 has a plurality of passageways 18 formed on the upper and lower surfaces 121 of the first tongue portion 120 and extending backwardly to communicate with the depression 17. A pair of resisting portions 170 are formed at two lateral sides of the depression 17.

The contact module are assemble to the insulative housing 1 from back to front and includes an insulative plate, and a plurality of second contacts 42 insert molded with the insulative plate. The insulative plate has a horizontal plate 2 and a vertical plate 3. The horizontal plate 2 defines a main portion 21 accommodated in the receiving room 16 and a second tongue portion 22 extending forwardly from a front face of the main portion 21 into the second receiving cavity 13. A pair of retaining portions 210 extending outwardly from two lateral sides of the main portion 21 and retained in the respective retaining grooves 160. Therefore, the horizontal plate 2 could be retained in the insulative housing 1 reliably. In the preferred embodiment of the present invention, the first and the second tongue portions 120, 22 are stacked and spaced from each other in a vertical direction. The first tongue portion 120 is parallel to the second tongue portion 22. The second tongue portion 22 includes a mounting surface 221 on which the second contacts 42 is located and facing the first tongue portion 120. The second tongue portion 22 is much thicker than the first tongue portion 12 along the vertical direction. The vertical plate 3 has a main body 31 accommodated in the depression 17, and a pair of protrusions 311 protruding outwardly from two lateral sides of the main body 31 for abutting against the resisting portions 170 so as to prevent the vertical plate 3 move forwardly.

The first contacts 41 of the preferred embodiment are elastic and for USB 2.0 protocol. Each first contact 41 comprises a convex shape elastic contact section 411, a retaining section 413, a bending section 41 bending downwardly from the retaining section 413 and a tail section 415 extending downwardly from a lower end of the bending section 41 to the retaining section 413. The contact sections 411 are located on the passageways 18 of the first tongue portion 120 and extend beyond the upper and the lower faces 121 to protrude into the first receiving cavity 12. The first contacts 41 include two contacts disposed on the upper surface 121 of the second tongue portion 103, and two contacts disposed on the lower surface 121 of the first tongue portion 120. The tail sections 415 are retained in the bottom wall 15 of the insulative housing 1 and extend downward beyond the insulative housing 1.

The second contacts 42 of the preferred embodiment are non-elastic. The second contact 42 comprises a plate-shaped contact portion 421, an offset portion 422 offsetting from the contact portion 421, an extending portion 423 extending backwardly from the offset portion 422, a bending portion 424 bending downwardly from the extending portion 423 and insert molded with the vertical plate 3, and a tail portion 425 on a distal end of the bending portion 424 to extend downwardly through the vertical plate 3. The offset portions 422 offset horizontally and outwardly from the respective contact portions 421 so as to increase the distances between the two adjacent second contacts 42. The offset portion 422 and the extending portion 423 are insert molded with the horizontal plate 2. The contact portions 421 are exposed to the second receiving cavity 13 for mating with the B-type USB 3.0 plug. The second contacts 42 of the preferred embodiment includes a middle grounding contact and two pairs of first and second signal contacts respectively disposed on two sides of the grounding contact respectively. The contact portion 421 of the grounding contact is located on the mounting surface 221 of the second tongue portion 22 and is longer than that of the first or the second signal contacts so that the front end of the grounding contact is much closer to a free end of the second tongue portion 22. While insertion of B-type USB 3.0 plug, the B-type USB 3.0 plug contacts with the contact portion 421 of the grounding contact firstly and then contacts with the first and second signal contacts for better grounding protection. The extending portion 423 and the bending portion 424 of the middle grounding contact have a width along a transverse direction perpendicular to the front-to-back direction wider than that of two pairs of the first and second signal contacts so as to adjust the impedance between the pair of first and the pair of second signal contacts.

Referring to FIGS. 1-5, the metal shell includes a front shell 5 enclosing the insulative housing 1, a back shell 7 attached to the front shell 5 and a back side of the insulative housing 1. The front shell 5 is stamped from a unitary one-piece metal sheet to have a top wall 51, a pair of side walls 52 and a front wall 53 bending downwardly from front end of the top walls 52. Each side wall 52 has a latching arm 524 extending inwardly and upwardly from a lower end thereof for latching with the rib 150 of the insulative housing 1. Each side wall 52 further includes a plurality of locking holes 521 for latching with the projections 115 of the insulative housing 1, and a plurality of slits 528 to retain flexible latches 722 formed on the back shell 7. The vertical plate 3 is sandwiched between the insulative housing 1 and the back shell 7. Each side wall 52 has an engaging arm 522 extending backwardly from a front side thereof into the first receiving cavity 12 and retained in the slots 125 to abut against the corresponding plug. The top wall 51 encloses the second receiving cavity 13. The second tongue portion 22 is located between the top wall 51 and the first tongue portion 120. The second tongue portion 22 is parallel to both the top wall 51 and the first tongue portion 12. The front wall 53 locates at the front of the first and second receiving cavities 12, 13 and defines a inserting hole 531 through which the B-type USB 2.0 plug or the B-type USB 3.0 plug inserting to be received in the receiving cavity 101 non-simultaneously. The front wall 53 includes a pair of side edges 532 located at two lateral sides of the inserting hole 531, a bottom edge 534 located below the inserting hole 531 and connecting the side edges 532, and a pair of bending edges 533 bending backwardly from the side edges 532. The bending edges 533 have perforations 5330 latching with barbs 523 formed on the side walls 52 so as to firm the front wall 53 on the side walls 52. The inserting hole 531 has an outline in accordance with the receiving cavity 101 for the B-type USB 2.0 plug or the B-type USB 3.0 plug passing through. The inserting hole 531 includes a lower hole 5310 having a pair of chamfers 5313 at two upper corners thereof and acting as keys for regulating the insertion orientation of the B-type USB 2.0 plug or the B-type USB 3.0 plug, and an upper hole 5312 communicating with lower hole 5310. The lower hole 5310 has a wider width and a higher height than that the upper hole 5312.

The grounding means 6 is made of another piece of metal sheet and includes a main plate 61 extending obliquely upwardly at a predetermined acute angle relative to the front face 112 of the insulative housing 1, a retaining plate 68 integrally extending from a bottom edge of the main plate 61, and a bending plate 62 bending upwardly and backwardly at an appropriate angle relative to the main plate 61. The main plate 61 forms a closed-rim opening 60 in accordance with the receiving cavity 101 and the inserting hole 531 for the B-type USB 2.0 plug or the B-type USB 3.0 plug passing through. The opening 60 includes a opened-rim lower opening 601 having a pair of chamfers 603 at two upper corners thereof and acting as keys for regulating the insertion orientation of the B-type USB 2.0 plug or the B-type USB 3.0 plug, and an opened-rim upper opening 602 communicating with the lower opening 601 in the vertical direction. The lower opening 601 has a wider width and a higher height than that of the upper opening 602. In this invention, the opening 60 of the grounding means 6 could prevent the B-type USB 2.0 plug or the B-type USB 3.0 plug from miscasting with the receiving cavity 101 before the plug inserting into the receiving cavity 101. The retaining plate 68 includes a bight portion 63 connecting to the bottom edge of the main plate 61 and bowed upwardly, a pair of tangs 64 extending upwardly from the bight portion 63, and a spring tab 65 extending backwardly from the bight portion 63. The bight portion 63 is sandwiched between the front face 112 of the bottom wall 15 and the bottom edge 534 of the front wall 53. The bottom edge 534 of the front wall 53 is retained in a slit formed between the main plate 61 and the bight portion 63. The tangs 64 are retained in clearances 539 formed between the side edges 532 and the engaging arms 522. The spring tab 65 extending into the first receiving cavity 12 and parallel to the first tongue portion 120 to abut upwardly against the B-type USB 2.0 plug or the B-type USB 3.0 plug and prevent the grounding means 6 downwardly getting away from the front shell 5. The bending portion 62 has an arc portion 66 connecting to the main plate 61 for abutting against the metal panel to electrically connect with the metal panel for Electrostatic Discharge (ESD).

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulative housing defining a receiving cavity for receiving a plug, the receiving cavity comprising a first receiving cavity with a first tongue portion extending therein, and a second receiving cavity communicating with the first receiving cavity with a second tongue portion extending therein;

a plurality of first contacts disposed on opposite upper and lower surfaces of the first tongue portion and protruding into the first receiving cavity;

a plurality of second contacts disposed on a mounting surface of the second tongue portion and exposed to the second receiving cavity;

a metal shell enclosing the insulative housing; and a grounding means attached to the metal shell and oblique to a front face of the insulative housing for abutting against a metal panel and defining an opening for insertion of the plug, the opening comprising a lower opening with a pair of chamfers on top thereof acting as keys for regulating the insertion orientation of the plug, and an upper opening communicating with the lower opening in a vertical direction and being essentially narrower than the lower opening.

2. The electrical connector according to claim 1, wherein the receiving cavity is in accordance with the opening, the insulative housing has a pair of chamfered portions on top of the first receiving cavity, the second receiving cavity being essentially narrower than the first receiving cavity.

3. The electrical connector according to claim 1, wherein the lower opening is of corresponding shape to accommodate a standard B-type USB 2.0 plug, the lower and upper openings are combined to accommodate a standard B-type USB 3.0 plug.

4. The electrical connector according to claim 1, wherein the insulative housing has a receiving room located at back of the second receiving cavity and communicating with the second receiving cavity along a front-to-back direction, the receiving room and the second receiving cavity extend upwardly through a top face of the insulative housing, the electrical connector comprises a contact module assembled to the insulative housing, the contact module comprises a horizontal plate and the second contacts, the second contacts are insert molded with the horizontal plate, the horizontal plate comprises a main portion accommodated in the receiving room and the second tongue portion integrally extending forwardly from the main portion.

5. The electrical connector according to claim 4, wherein the second contacts comprise plate-shaped contact portions extending horizontally, offset portions offsetting outwardly and horizontally from the contact portions, extending portions extending backwardly from the offset portions, bending portions bending downwardly from the extending portions and tail portions extending downwardly from a lower end of the bending portion, the contact portions, the offset portions, and the extending portions are insert molded with the horizontal plate, the contact module comprises a vertical plate extending perpendicularly to the horizontal plate, the bending portions are insert molded with the vertical plate, the tail portions extend downwardly beyond the vertical plate.

6. The electrical connector according to claim 1, wherein the shell has a top wall, a pair of side walls extending downwardly from two lateral sides of the top wall, a front wall bending downwardly from a front end of the top wall, the front wall defines an inserting hole in accordance with the opening, the inserting hole has a lower hole with a pair of chamfers on top thereof acting as keys for regulating the insertion orientation of the plug, and an upper hole communicating with the lower hole in the vertical direction and being essentially narrower than the lower hole.

7. The electrical connector according to claim 6, wherein the insulative housing has a pair of slots located at two sides of the first receiving cavity and communicating with the first receiving cavity, the side walls have a pair of engaging arms bending backwardly from front sides thereof for being retained into the respective slots and protruding into the receiving cavity for abutting against two sides of the plug.

8. The electrical connector according to claim 7, wherein the grounding means comprises a main plate extending obliquely upwardly at an acute angle relative to the front face of the insulative housing and defining the opening, a retaining plate integrally extending from a bottom edge of the main plate and sandwiched between the front wall and the front face of the insulative housing.

9. The electrical connector according to claim 8, wherein the grounding means further comprises a bending plate bending backwardly at an appropriate angle relative to the main plate and defining an arc portion connecting to the main plate for abutting against the metal panel.

10. The electrical connector according to claim 8, wherein the retaining plate comprises a bight portion connecting to the bottom edge of the main plate and bowed upwardly for being sandwiched between the front wall and the front face of the insulative housing, a pair of tangs extending upwardly from the bight portion and retained in clearances formed between the front wall and the engaging arms, the front wall has a bottom edge retained in a slit formed between the main plate and the bight portion.

11. The electrical connector according to claim 10, wherein the retaining plate further comprises a spring tab extending backwardly from the bight portion into the first receiving cavity and parallel to the first tongue portion for abutting upwardly against the plug.

12. An electrical connector comprising:

an insulative housing defining a front face and a receiving cavity recessed backwardly from the front face for receiving a plug, and a pair of slots at two lateral sides of the receiving cavity and communicating with the receiving cavity;

a plurality of contacts extending into the receiving cavity for mating with the plug;

a metal shell enclosing the insulative housing and comprising a top wall, a pair of side walls extending downwardly from two lateral sides of the top wall, a front wall bending downwardly from front end of the top wall, the front wall defining an inserting hole in accordance with the receiving cavity, the side walls having a pair of engaging arms bending backwardly from respective front sides thereof for being retained into the respective slots and protruding into the receiving cavity for abutting against two sides of the plug; and a grounding means comprising a main plate extending obliquely relative to the front face of the insulative housing and defining an opening in accordance with the receiving cavity, a retaining plate integrally extending from a bottom edge of the main plate and sandwiched between the front wall and the front face of the insulative housing, and a bending plate bending backwardly at an appropriate angle relative to the main plate for abutting against the metal panel, the retaining plate comprising a bight portion connecting to the bottom edge of the main plate for being sandwiched between the front wall and the front face of the insulative housing, a pair of tangs extending from the bight portion and retained in clearances formed between the front wall and the engaging arms.

13. The electrical connector according to claim 12, wherein the retaining plate further comprises a spring tab extending backwardly from the bight portion into the receiving cavity for abutting upwardly against a lower side of the plug.

14. The electrical connector according to claim 12, wherein the bending plate defining an arc portion connecting to the main plate for abutting against the metal panel.

15. The electrical connector according to claim 12, wherein the opening comprising a lower opening with a pair of chamfers on top thereof, and an upper opening communicating with the lower opening in a vertical direction and being essentially narrower than the lower opening, the lower opening is of corresponding shape to accommodate a standard B-type USB 2.0 plug, the lower and upper openings are combined to accommodate a standard B-type USB 3.0 plug.

16. The electrical connector according to claim 12, wherein the receiving cavity comprises a lower first receiving cavity recessed backwardly from the front face of the insulative housing with a first tongue portion extending therein, an upper second receiving cavity communicating with the first receiving cavity in a vertical direction, the contacts comprise a plurality of first contacts having convex shape elastic contact sections disposed on opposite upper and lower surfaces of the first tongue portion and protruding into the first receiving cavity for mating with the plug, the electrical connector further comprises a contact module assembled to the insulative housing, the contact module comprises a second tongue portion extending into the second receiving cavity, and a plurality of second contacts having non elastic contact portions being insert molded with the second tongue portion and exposed to the second receiving cavity for mating with the plug.

17. An electrical connector for use with a plug, comprising:

an insulative housing defining a mating port forwardly communicating with an exterior for receiving the plug therein;

a plurality of contacts disposed in the housing with contacting sections exposed into the mating port;

a metallic shell enclosing said housing and defining a top wall covering a top face of the housing, a front wall unitarily extending downwardly from a front edge of the top wall and defining a first opening to communicate said mating port with an exterior, a pair of side walls unitarily extending downwardly from two opposite side edges of the top wall, a pair of engaging arms each unitarily extending curvedly and backwardly from a front edge of each corresponding side walls and into the mating port for engagement with the plug; and a metallic grounding device including a main plate obliquely located in front of the and defining a second opening essentially in alignment with the first opening in a front-to-back direction, and a pair of tangs extending upwardly around a bottom edge of the main plate and sandwiched between the front wall and the corresponding engaging arms, respectively.

18. The electrical connector as claimed in claim 17, wherein all said first opening, said second opening and said mating port define a similar configuration with one wide half and one narrow half in a vertical direction.

19. The electrical connector as claimed in claim 17, wherein said grounding device further includes a tab around said bottom edge of the main plate and extending into the mating port and seated upon the housing for restraining downward movement of the grounding device relative to the shell.

20. The electrical connector as claimed in claim 19, wherein said grounding device further includes a retaining plate unitarily extending from the bottom edge of the main plate and sandwiched between the main plate and the front face of the housing, from which both said tab and said pair of tangs unitarily extend upwardly.

* * * * *